US008878868B2

(12) United States Patent
Kurosaki et al.

(10) Patent No.: US 8,878,868 B2
(45) Date of Patent: Nov. 4, 2014

(54) INFORMATION PROCESSING APPARATUS, INFORMATION PROCESSING METHOD AND PROGRAM

(75) Inventors: Daisuke Kurosaki, Tokyo (JP); Akiko Tsuzuki, Tokyo (JP); Naoshi Koizumi, Tokyo (JP); Tomoyuki Kitagawa, Kanagawa (JP); Tomohiro Tsuyuhara, Kanagawa (JP)

(73) Assignee: Sony Corporation, Tokyo (JP)

( * ) Notice: Subject to any disclaimer, the term of this patent is extended or adjusted under 35 U.S.C. 154(b) by 1199 days.

(21) Appl. No.: 12/535,217

(22) Filed: Aug. 4, 2009

(65) Prior Publication Data

US 2010/0053189 A1 Mar. 4, 2010

(30) Foreign Application Priority Data

Aug. 29, 2008 (JP) ..... 2008-221855

(51) Int. Cl.
*G09G 5/02* (2006.01)
*G09G 5/00* (2006.01)

(52) U.S. Cl.
CPC ..... *G09G 5/00* (2013.01); *G09G 2320/0606* (2013.01); *G09G 2320/0666* (2013.01); *G09G 2320/0613* (2013.01)
USPC ..... 345/593; 345/589; 345/690

(58) Field of Classification Search
None
See application file for complete search history.

(56) References Cited

U.S. PATENT DOCUMENTS

| | | | | |
|---|---|---|---|---|
| 6,223,283 | B1 | 4/2001 | Chaiken et al. | |
| 7,142,226 | B2 * | 11/2006 | Sakuta et al. | 345/690 |
| 8,497,870 | B2 * | 7/2013 | Borg et al. | 345/589 |
| 2002/0105527 | A1 | 8/2002 | Hata et al. | |
| 2004/0212610 | A1 | 10/2004 | Hamlin | |
| 2007/0291038 | A1 | 12/2007 | Herz | |

FOREIGN PATENT DOCUMENTS

| | | | |
|---|---|---|---|
| EP | 1 818 904 | A2 | 8/2007 |
| EP | 1 818 904 | A3 | 8/2007 |
| JP | 11-102175 | | 4/1999 |
| JP | 11-296338 | | 10/1999 |
| JP | 11-312072 | | 11/1999 |
| JP | 2001-309315 | | 11/2001 |
| JP | 2002-278522 | | 9/2002 |
| JP | 2002-341843 | | 11/2002 |
| JP | 2004-341131 | | 12/2004 |

OTHER PUBLICATIONS

Office Action issued Nov. 8, 2010, in Europe Patent Application No. 09 168 814.3.
Office Action issued Feb. 6, 2012 in European Patent Application No. 09 168 814.3-2205.

* cited by examiner

*Primary Examiner* — Antonio A Caschera
(74) *Attorney, Agent, or Firm* — Oblon, Spivak, McClelland, Maier & Neustadt, L.L.P.

(57) ABSTRACT

The present invention provides an information processing apparatus having: a display controlling unit for starting any one of a plurality of application programs and displaying contents on a display screen; a determining unit for determining the application program started by the display controlling unit; and a changing unit for changing a plurality of image quality parameters for setting image quality of the display screen in accordance with the application program determined by the determining unit.

20 Claims, 10 Drawing Sheets

FIG. 7

450

| | STANDARD | DVD/BD | TV | x.v.Cloor | PRINT | EXTERNAL OUTPUT |
|---|---|---|---|---|---|---|
| DISPLAY GAMMA CORRECTION | R="00000112..."<br>G="000000e1..."<br>B="0000007e..." | R="00000085..."<br>G="0000006e..."<br>B="0000003a..." | R="00000085..."<br>G="0000006e..."<br>B="0000003a..." | R="00000112..."<br>G="000000e1..."<br>B="0000007e..." | R="00000142..."<br>G="000000ee..."<br>B="00000074..." | (Default)<br>R="00000101..."<br>G="00000101..."<br>B="00000101..." |
| MOVING IMAGE COLOR CORRECTION (MOVING IMAGE CREATION PARAMETERS) | Brightness="-11"<br>Contrast="102"<br>Gamma="100"<br>Hue="0"<br>Saturation="100" | Brightness="-11"<br>Contrast="102"<br>Gamma="100"<br>Hue="0"<br>Saturation="115" | Brightness="-21"<br>Contrast="109"<br>Gamma="100"<br>Hue="0"<br>Saturation="121" | (Default)<br>Brightness="0"<br>Contrast="100"<br>Gamma="100"<br>Hue="0"<br>Saturation="100" | (Default)<br>Brightness="0"<br>Contrast="100"<br>Gamma="100"<br>Hue="0"<br>Saturation="100" | (Default)<br>Brightness="0"<br>Contrast="100"<br>Gamma="100"<br>Hue="0"<br>Saturation="100" |
| ICC monitor profile (STATIC IMAGE COLOR SPACE CONVERSION PARAMETERS) | display profile_D65.icc | X | X | X | display profile_D50.icc | -<br>(FOLLOW SELECTED MODE) |
| Color conversion Matrix (MOVING IMAGE COLOR SPACE CONVERSION PARAMETERS) | (Default)<br>1 0 0<br>0 1 0<br>0 0 1 | (Default)<br>1 0 0<br>0 1 0<br>0 0 1 | (Default)<br>1 0 0<br>0 1 0<br>0 0 1 | 0.69 0.27 0.02<br>0.02 0.98 -0.01<br>0.00 0.03 0.95 | (Default)<br>1 0 0<br>0 1 0<br>0 0 1 | -<br>(FOLLOW SELECTED MODE) |
| PANEL COLOR TEMPERATURE | 6500 | 6500 | 6500 | 6500 | 5000 | -<br>(FOLLOW SELECTED MODE) |

INFORMATION PROCESSING APPARATUS, INFORMATION PROCESSING METHOD AND PROGRAM

BACKGROUND OF THE INVENTION

1. Field of the Invention

The present invention relates to an information processing apparatus, an information processing method and a program, and particularly, to an information processing apparatus, an information processing method and a program all capable of changing image quality parameters for correcting the image quality.

2. Description of the Related Art

Recently, a display device such as a computer display is capable of adjustment of lightness, tint and the like of the display screen so as to give optimal screen images. The image quality parameters are adjusted by a user selecting image quality parameters for correction of image quality so as to give optimal images, setting image quality parameters in advance in accordance with types of LCD panel or the like.

The image quality parameters are dependent on each other. For example, setting of color temperature of the display screen is changed, color setting is changed in accordance with the changed setting of color temperature. Then, there is disclosed a technique for clarifying the relation between the image quality parameters changed by the user and data changed in accordance with the parameter changes (see the patent document 1, for example). According to the patent document 1, the setting items set by the user and their setting data are in a unified relation thereby to be able to reduce errors in setting adjustment.

[Patent document 1] Japanese Patent Application Laid-open No. 11-102175

SUMMARY OF THE INVENTION

However, in order to optimize the image quality of the display screen, there is a need to set various image quality parameters for setting of gamma correction and color space conversion as well as the above-mentioned color temperature. As these parameters depend on each other, when one parameter is changed, the others need to be changed in accordance with the parameter changes.

Further, as optimal image quality parameter setting differs depending on an LCD panel or application, there is a need to change the plurality of image quality parameters in consideration of all factors including used LCD panel, running application and the like. When each image quality parameter is set by user's input, the user must understand the meaning of each image quality parameter and consider all of the LCD panel, running application and the like.

Particularly, there arises an issue that it is difficult for a user to set an image quality parameter appropriately for each application as the optimal image quality parameter setting depends on a running application.

Then, the present invention addresses the above-identified, and other issues associated with related-art methods and apparatuses, and provides new and improved information processing apparatus, information processing method and program capable of readily setting an optimal image quality parameter.

According to an embodiment of the present invention, there is provided an information processing apparatus including: a display controlling unit for starting any one of a plurality of application programs and displaying contents on a display screen; a determining unit for determining the application program started by the display controlling unit; and a changing unit for changing a plurality of image quality parameters for setting image quality of the display screen in accordance with the application program determined by the determining unit.

With this structure, the running application program is determined and then, the determined application program is used as a basis to change the plurality of image quality parameters for setting the image quality of the display screen. Accordingly, optimal image quality parameters can be set in accordance with the running application program.

The information processing apparatus may further include a storing unit for storing identification information of the application program as associated with the image quality parameters, wherein the determining unit may determine the identification information of the application program started by the display controlling unit, and the changing unit may change the image quality parameters for setting the image quality of the display screen to the image quality parameters in associated with identification information of the application program determined by the determining unit.

The application programs may be programs for displaying static image contents or moving image contents on the display screen.

The determining unit may determine a LCD panel and/or a graphics model used, and the changing unit may change the image quality parameters in accordance with the LCD panel and/or the graphics model determined by the determining unit.

The image quality parameters may include parameters for correcting image quality of static image contents or moving image contents.

The image quality parameters may include parameters for correcting panel color temperature The changing unit may invalidate change of the image quality parameters when the display screen is mounted on a display device external to the information processing apparatus.

The storing unit may store the image quality parameters associated with a plurality of image quality modes set for respective display purposes, the information processing apparatus further may include a selecting unit for selecting any of the image quality modes in accordance with the application program determined by the determining unit, and the changing unit may change the image quality parameters for setting the image quality of the display screen to the image quality parameters associated with the image quality mode selected by the selecting unit.

The storing unit may store predetermined number of image quality modes as associated with identification information of the application programs.

The selecting unit may select the image quality mode in accordance with user operation.

According to another embodiment of the present invention, there is provided an information processing method including the steps of: starting any one of a plurality of application programs and displaying contents on a display screen; determining the application program started; and changing a plurality of image quality parameters for setting image quality of the display screen in accordance with the application program determined.

According to another embodiment of the present invention, there is provided a program for making a computer function as an information processing apparatus including: a display controlling unit for starting any one of a plurality of application programs and displaying contents on a display screen; a determining unit for determining the application program started by the display controlling unit; and a changing unit for changing a plurality of image quality parameters for setting image quality of the display screen in accordance with the application program determined by the determining unit.

According to this program, it becomes possible to make hardware resources of a computer including, for example, CPU, ROM or RAM execute each structural function of the movie player as described above.

According to the embodiments of the present invention described above, an appropriate image quality parameter can be set easily.

BRIEF DESCRIPTION OF THE DRAWINGS

FIG. 7 is an explanatory view for showing a list of settings of the image quality mode according to the embodiment;

DETAILED DESCRIPTION OF THE PREFERRED EMBODIMENTS

Figure 1:
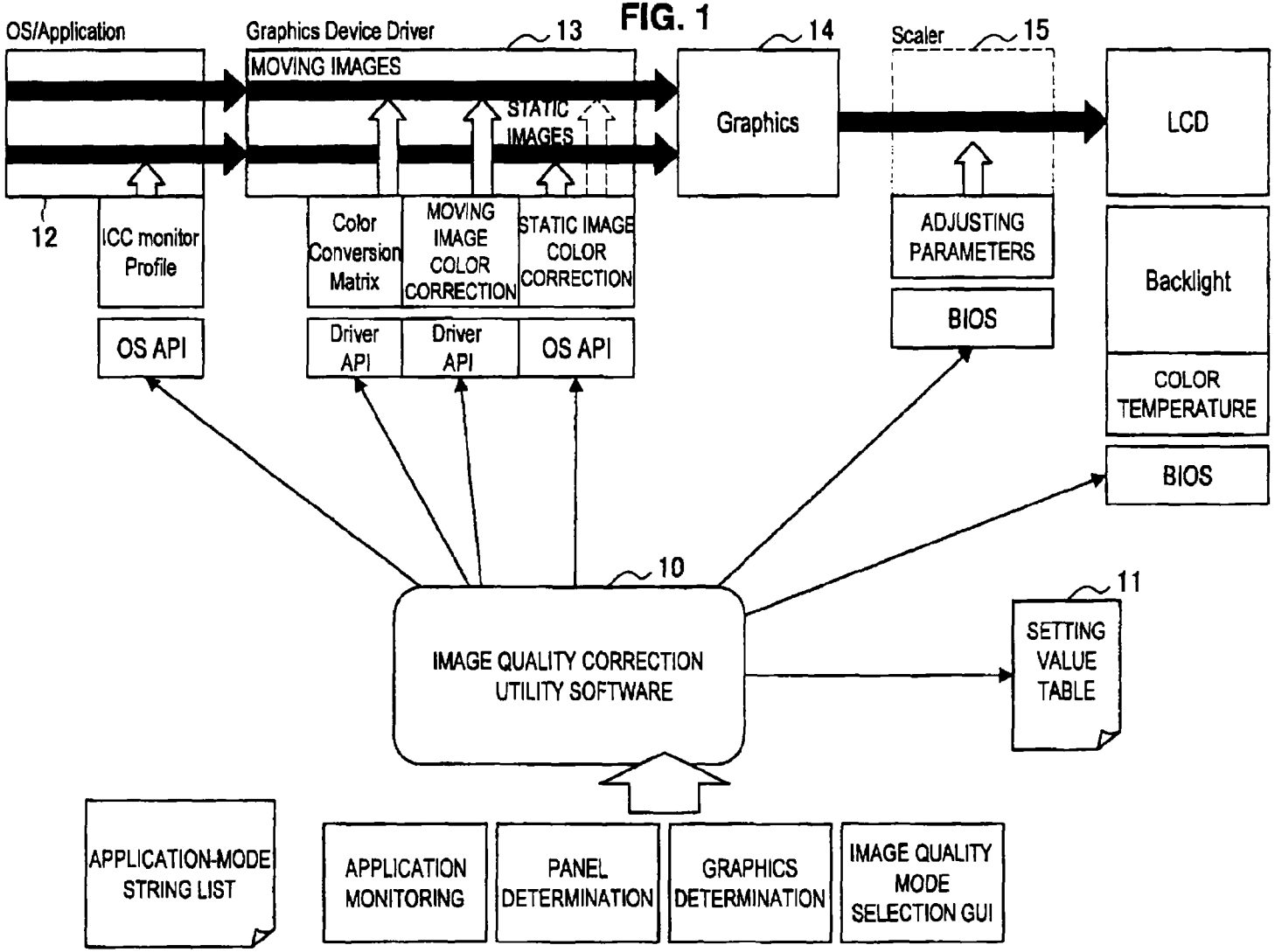
FIG. 1 is an explanatory view for explaining image correction according to an embodiment of the present invention.

Hereinafter, preferred embodiments of the present invention will be described in detail with reference to the appended drawings. Note that, in this specification and the appended drawings, structural elements that have substantially the same function and structure are denoted with the same reference numerals, and repeated explanation of these structural elements is omitted.

This "DETAILED DESCRIPTION OF THE PREFERRED EMBODIMENTS" will be described in the following order.

[1] Purpose of This Embodiment

[2] Hardware Configuration of Information Processing Apparatus

[3] Functional Structure of Information Processing Apparatus

[4] Operation of Information Processing Apparatus

[1] Purpose of this Embodiment

First description is made about a purpose of the embodiments of the present invention. Recently, in a display device such as a computer display, its lightness, tint and the like are adjustable so that the display device is capable of optimal displays. Such image quality parameters are adjusted by a user's selecting image quality parameters for correcting the image quality so as to give optimal displays, setting the image quality parameters in advance in accordance with the LCD panel type, or the like.

As the plurality of image quality parameters are related to each other, for example, when the color temperature of the display screen is changed, the color is changed in accordance with the setting of changed color temperature. In order to optimize the image quality of the display screen, not only the color temperature and color but also various image quality parameters for setting the contract, gamma and other properties need to be set. These parameters are dependent on each other. If one of them is changed, the others have to be changed in accordance with the changed parameter.

In addition, as appropriate setting of the image quality parameters depends on the LCD panels or application, the plurality of image quality parameters have to be changed with the LCD panel, running application and the like all considered. When each image quality parameter is set by user's input, the user has to understand the meaning of the image quality parameter and consider all of the LCD panel, running application and other factors. Particularly, as the optimal image quality parameter setting is different for each running application, there is an issue that it is difficult for the user to set the image quality parameters optimally for each application.

Figure 10:
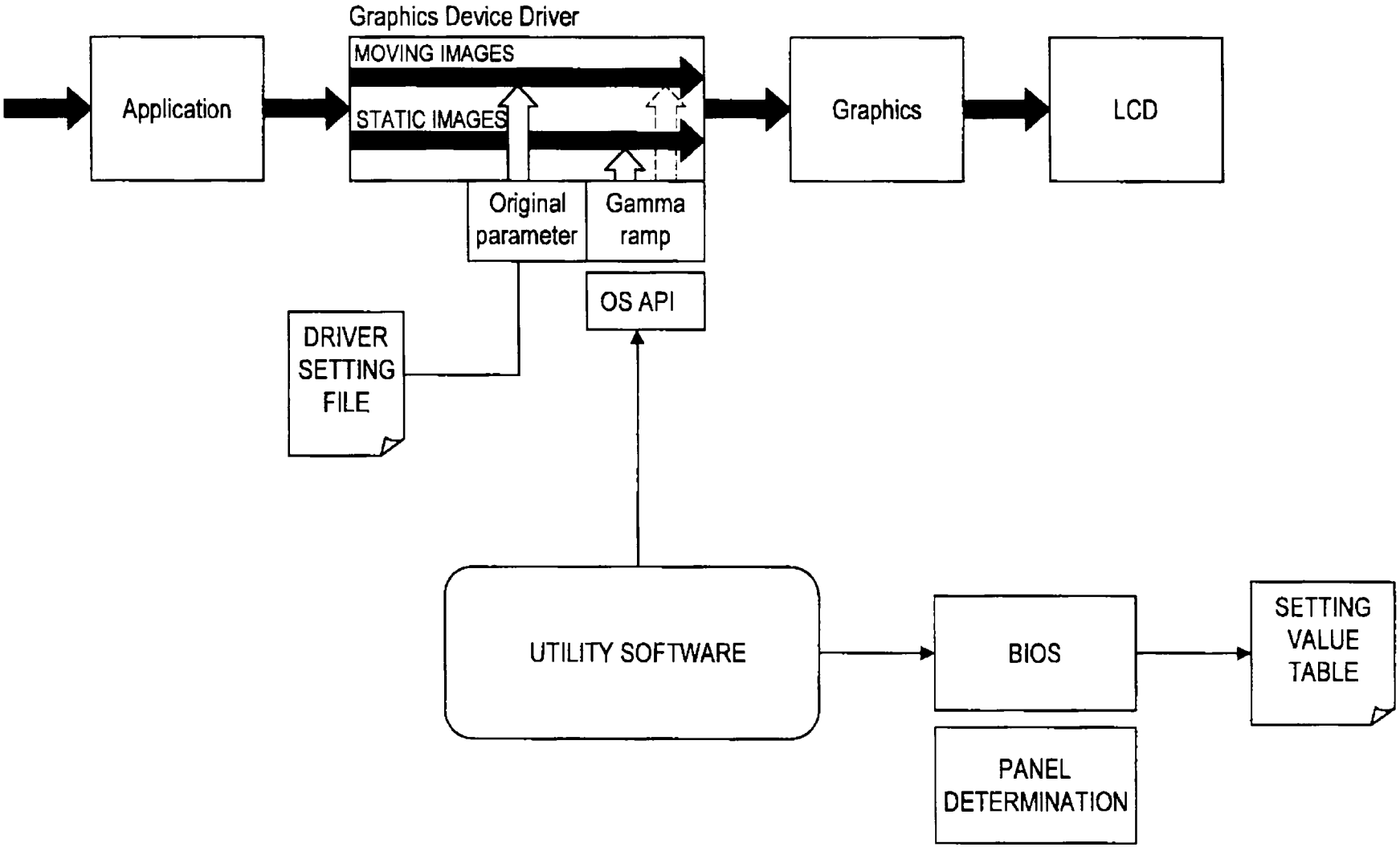
FIG. 10 is an explanatory view for explaining conventional image quality correction.

FIG. 10 is an explanatory view for explaining the conventional image quality correction. Conventionally, as shown in FIG. 10, image quality correction is performed based on the setting values of image quality parameters set in a Graphic Device Driver or BIOS (Basic Input/Output System). For example, contents input to the PC are subjected to decoding or the like by application and then to image quality correction by the driver.

Then, the contents pass through the Graphics, which is hardware for displaying the contents, or the like and are displayed as static image or moving image contents on the LCD (Liquid Crystal Display). The image quality correction by the driver includes correction of static image contents and correction of moving image contents, and its setting manner is different per driver. In other words, the image quality parameter settings may not be changed for each LCD panel or used Graphics.

In addition, panel determination information of the BIOS can be used to change the image quality parameter settings. However, in this case, the image quality parameter settings have to be changed by changing the setting value table of BIOS binary. Further, the image quality correction by the driver is independent from the image quality correction by the BIOS, it makes more difficult for a user to set the image quality parameters optimally.

Then, in view of the foregoing, an information processing apparatus according to embodiments of the present invention has been created. With the information processing apparatus 100 according to the embodiments, it is possible to set optimal image quality parameters easily.

FIG. 1 is an explanatory view for explaining image quality correction according to an embodiment. In this embodiment, as shown in FIG. 1, image quality correcting parameters for each step from inputting to outputting of the contents displayed on the LCD, including image quality correction by the OS (Operating System) or application 12, image quality correction by the Graphics Device Driver 13, image quality correction by the scaler 15 and the like, can be controlled in a unified manner. Further, the image quality parameter settings can be changed in accordance with results of determining the used panel running application and graphics.

Furthermore, conventionally, the image quality parameters of the Graphics Device Driver and the BIOS are set using the respective setting value tables of different formats. However, in this embodiment, the setting value table 11 of common format is only used to be able to set the image quality parameters collectively or simply. For example, the image quality correction utility 10 can change collectively and simply the image quality parameters of each step by using the setting value table 11 having the plurality of parameters for correcting the image quality listed therein.

In this embodiment, the image processing apparatus 100 capable of setting image quality parameters is structured to be integral with a display device such as the LCD, but is not limited to this example. For example, the information processing apparatus may be structured as an apparatus separate from the display device. The information processing apparatus 100 is, for example, a personal computer (hereinafter referred to as PC). Particularly, this embodiment is described by way of an example of a notebook PC having a PC main body including a processing device and storage device and a display device structured integrally.

[2] Hardware Configuration of Information Processing Apparatus

Figure 2:
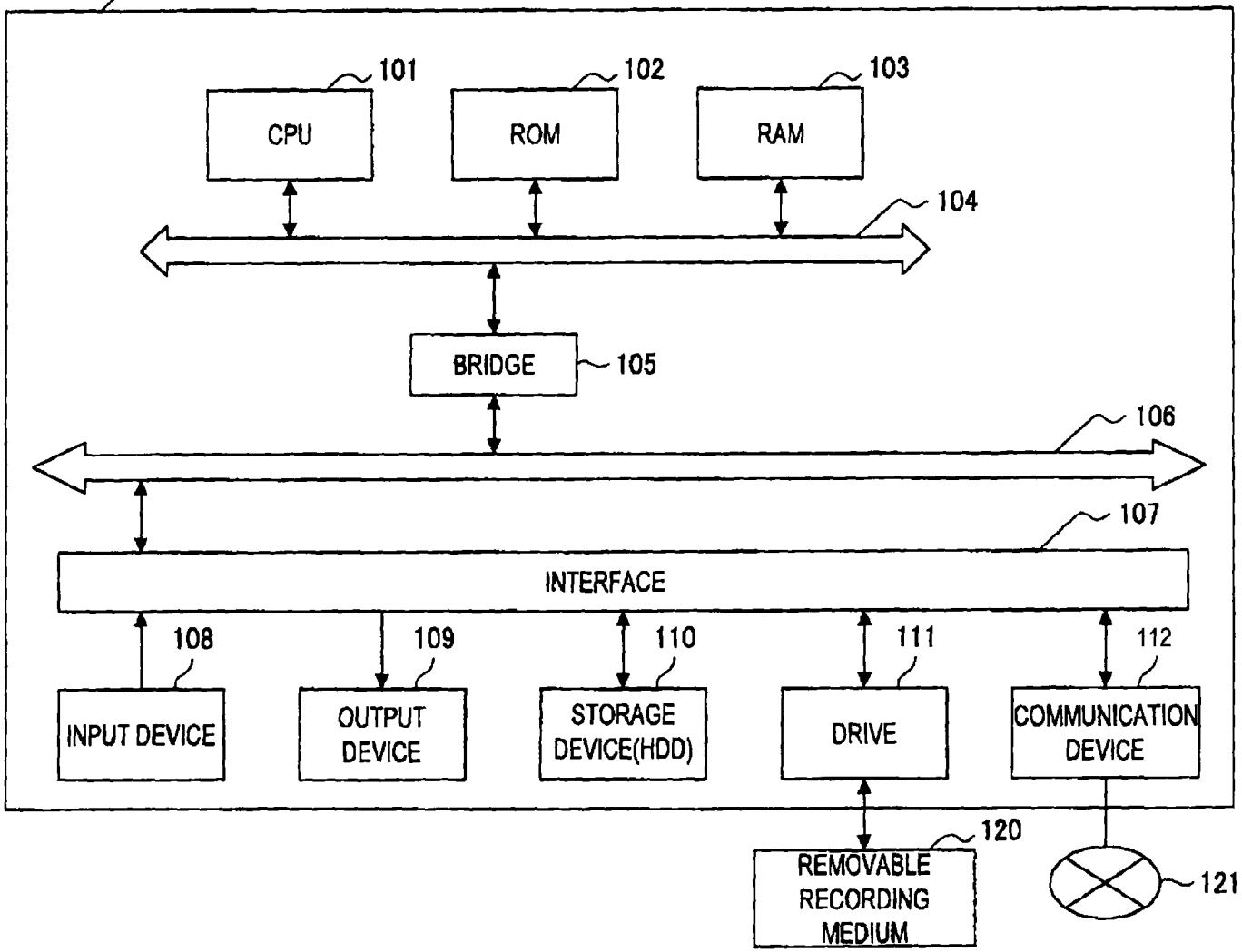
FIG. 2 is a block diagram for illustrating a hardware configuration of the information processing apparatus according to the embodiment.

Next, FIG. 2 is used to explain the hardware configuration of the information processing apparatus 100 according to this embodiment. FIG. 2 is a block diagram showing the hardware configuration of the information processing apparatus 100 according to this embodiment.

FIG. 2 is an explanatory view illustrating the hardware configuration of the information processing apparatus 100 according to this embodiment. The information processing apparatus 100 includes a CPU (Central Processing Unit) 101, a ROM (Read Only Memory) 102, a RAM (Random Access Memory) 103, a host bus 104, a bridge 105, an external bus 106, an interface 107, an input device 108, an output device 109, a storage device (HDD) 110, a drive 111 and a communication device 112.

The CPU 101 functions as a processing device and control device and controls all operations inside the information processing apparatus 100 in accordance with various programs. In addition, the CPU 101 may be a micro processor. The ROM 102 stores computing parameters, programs by used the CPU 101 and the like. The RAM 103 temporarily stores programs used in execution of the CPU 101, parameters appropriately changed in the execution and the like. These are connected to each other via the host bus 104 made up of a CPU bus or the like.

The host bus 104 is connected to the external bus 106 such as a PCI (Peripheral Component Interconnect/Interface) bus via the bridge 105. Here, the host bus 104, the bridge 105 and the external bus 106 are not necessarily structured separately, but may be embodied into one bus.

The input device 108 has inputting means for a user to input information, such as a mouse, a keyboard, a touch panel, a button, a microphone, a switch and a lever and an input control circuit for generating an input signal based on the user's input to output the same to the CPU 101. The user of the information processing apparatus 100 operates the input device 108 thereby to input various type data into or give the instructions of processing to the information processing apparatus 100.

The output device 109 has a display device such as a CRT (Cathode Ray Tube) display device, a liquid crystal display (LCD) device, a OLED (Organic Light Emitting Display) device and a lamp, and a speech output device such as a speaker and a headphone. The output device 109 outputs reproduce contents, for example. More specifically, the display device displays the various types of information such as reproduced video data in the form of texts or images. Meanwhile, the speech output device converts the reproduced speed data or the like into speech and outputs the same.

The storage device 110 is a device for data storage and is structured as one example of storage of the information processing apparatus 100 according to this embodiment. The storage device 110 may include a recording medium, a recording device for recording data in the recording medium, a reading device for reading the data from the recording medium and a deletion device for deleting the data from the recording medium. The storage device 110 has, for example, a HDD (Hard Disk Drive). This storage device 110 starts the hard disk and stores the programs executed by the CPU 101 and various data. In addition, this storage device 110 stores content data, meta data, device data and the like.

The drive 111 is a reader/writer for the recording medium and is mounted inside or outside of the information processing apparatus 100. The drive 111 reads the information stored in the removable recording medium 120 such as a mounted magnetic disk, optical disc, magnetic optical disk, semiconductor memory or the like, and outputs the information to the RAM 103.

The communication device 112 is, for example, a communication interface having a communication device or the like for connecting to the communication network 121. The communication device 112 may be a communication device designated for wireless LAN (Local Area Network), a communication device designated for wireless USB or a wire communication device for wire or cable communication. This communication device 112 sends various data such as content data, and content list to the external device or receives them from the external device via the communication network 121.

[3] Functional Structure of Information Processing Apparatus

Up to this point, the hardware configuration of the information processing apparatus 100 according to this embodiment has been described with reference to FIG. 2. Next description is made about the function of the information processing apparatus 100 according to this embodiment, with reference to FIG. 3.

Figure 3:
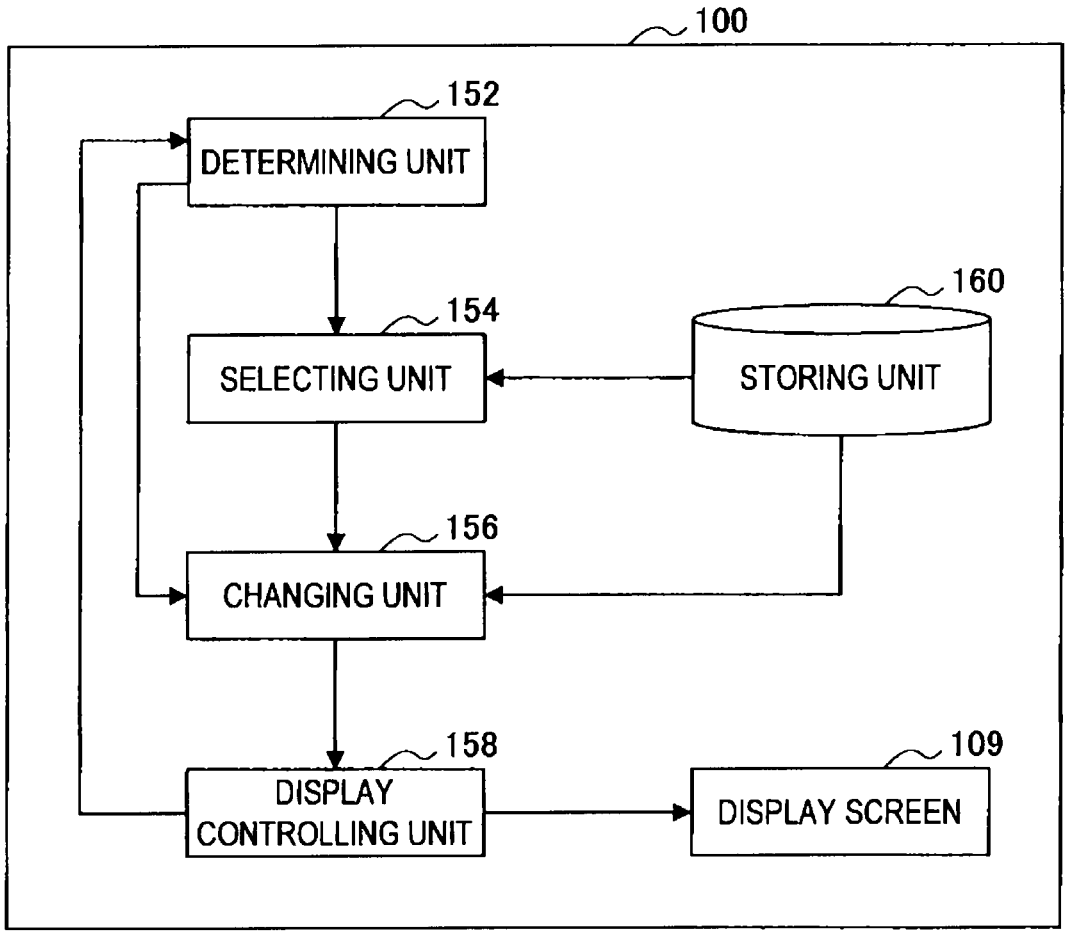
FIG. 3 is a block diagram for illustrating a functional structure of the information processing apparatus according to the embodiment.

FIG. 3 is a block diagram illustrating the functional structure of the information processing apparatus 100 according to this embodiment. As shown in FIG. 3, the information processing apparatus 100 according to this embodiment has a determining unit 152, a selecting unit 154, a changing unit 156, a display controlling unit 158, a storing unit 160, a display screen 109 and the like.

The determining unit 152 has a function of determining an application program started by the display controlling unit 158 described later. The determining unit 152 determines the running application program and provides the determination results to the selecting unit 154 and/or the changing unit 156. The determining unit 152 detects the identification information of the application program thereby to be able to determine the application program.

In addition, the determining unit 152 has a function of determining the used LCD panel. Further, the determining unit 152 has a function of determining the used graphics model. The determining unit 152 may determine both or any one of the LCD panel and the graphics model.

The selecting unit 154 has a function of selecting the image quality mode in accordance with the application program determined by the determining unit 152. The image quality mode selected by the selecting unit 154 may be set by automatically or user's input. The image quality mode will be described in details later.

The changing unit 156 has a function of changing a plurality of image quality parameters for setting the image quality of the display screen in accordance with the application program determined by the determining unit 152. Besides, when the used LCD panel and/or graphics model are determined by the determining unit 152, the LCD panel and/or graphics model may be used as a basis to change the plurality of image quality parameters.

The storing unit 160 stores identification information pieces of application programs and a plurality of image quality parameters in association with each other. The changing unit 156 changes the plurality of image quality parameters for setting the image quality of the display screen to a plurality of image quality parameters stored in the storing unit 160 in association with the identification information of the application programs.

In addition, the storing unit 160 stores a plurality of image quality parameters associated with the plurality of image quality modes set by display purpose. Further, the storing unit 160 stores a predetermined number of image quality modes in association with identification information of application programs.

The selecting unit 154 selects an image quality mode associated with the identification information of the application program. Then, the changing unit 156 changes the plurality of image quality parameters for setting the image quality of the display screen to a plurality of image quality parameters associated with the image quality mode selected by the selecting unit 154. The selecting unit 154 may select the image quality mode in accordance with user's operation.

The display controlling unit 158 has functions of running any of the plurality of application programs and displaying contents on the display screen 109.

Figure 4:
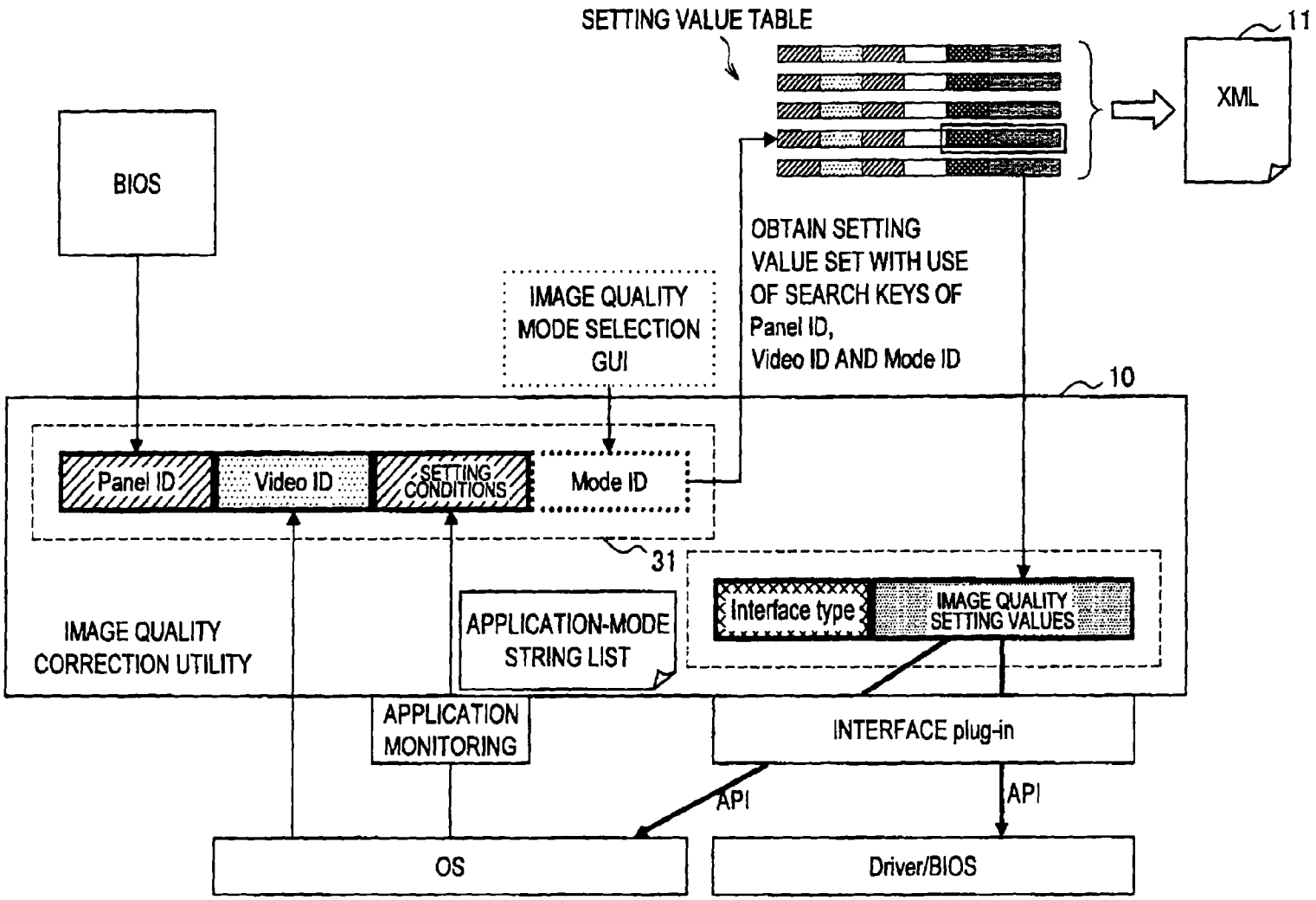
FIG. 4 is an explanatory view for explaining setting of image quality correcting parameters according to the embodiment.

The following description is made, with reference to FIG. 4, about the case where determination by the determining unit 152 and setting of a plurality of image quality parameters to be changed by the changing unit 156 are performed by image quality correction utility 10. FIG. 4 is an explanatory view for explaining setting of image quality correction parameters by the image quality correction utility 10.

As shown in FIG. 4, the image quality correction utility 10 first determines a used LCD panel and graphics model, a running application and the like and obtains setting conditions 31. For example, the used LCD panel can be determined from the "Panel ID" provided from the BIOS, and the used graphics model can be determined from the "Video ID" provided from the OS.

In determination of the running application, for example, in case of the system where a plurality of applications run simultaneously, the foreground application in the window may be determined as the running application.

In this case, the window title of the foreground application in the window is obtained. Then, the image quality correction utility 10 regards the application program corresponding to this window title as a running application program and determines the application program.

Besides, the running application may be a running application in the forward end among the application to be determined. In this case, a list of running application programs and the order of overlapping of the windows are obtained, the list is compared with a list of the applications to be determined, and an application in the forward end out of matched applications is determined as the running application.

Further, when the user selects the image quality mode from the image quality setting screen, the image quality correction utility 10 obtains "Mode ID" for identifying the selected image quality mode. Thus, the image quality correction utility 10 determines the used LCD panel and graphics model, the running application model and the selected image quality mode. Then, the image quality correction utility 10 uses the "Panel ID", the "Video ID", the running application program, the "Mode ID" as search keys, searches in the setting value table and obtains the setting values. In the setting value table, the "Panel ID", the "Video ID", the running application program, the "Mode ID" are associated with the image quality setting values.

Then, the image quality correction utility 10 makes use of the API (Application Program Interface) of the OS, the API of the driver or the API of the BIOS to change setting of the image quality parameters of each step.

Further, a predetermined number of image quality modes are prepared in advance, and the image quality modes may be selected not only by user but also automatically in accordance with the used LCD panel and graphics model or the running application model. In the case of automatic selection, the image quality mode can be set optimally by simpler operation.

Figure 5:
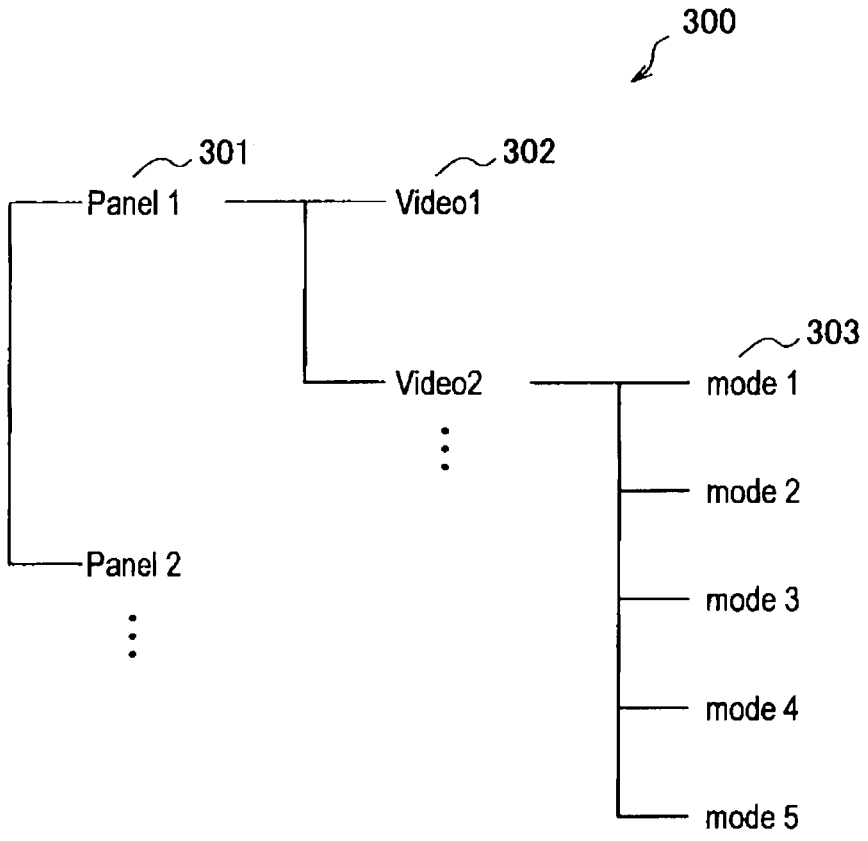
FIG. 5 is an explanatory view for explaining acquisition of an image quality mode by way of an image quality correction utility according to the embodiment.

The next description is made, with reference to FIG. 5, about automatic selection of the image quality mode in accordance with the used LCD panel and graphics model and the running application model. FIG. 5 is an explanatory view for explaining the image quality correction utility 10 obtaining five image quality mode. In FIG. 5, the data structure 300 of the "Panel ID", the "Video ID" and the "Mode ID" are illustrated by way of an example.

The image quality correction utility 10 determines the used LCD panel and graphics model to obtain the "Panel ID" 301 and the "Video ID" 302. For example, when the "Panel ID" 301 is Panel 1 and the "Video ID" 302 is Video 2, mode 1 to mode 5 of the "Mode ID" 303 associated with the Panel 1 and Video 2 are obtained.

Then, the image quality correction utility 10 determines the running application and selects any one of the mode 1 to mode 5 in accordance with the running application. When any one of the five image quality modes is selected by the user, the image quality correction utility 10 selects any one of the mode 1 to mode 5 in accordance with the selected image quality mode.

Figure 6:
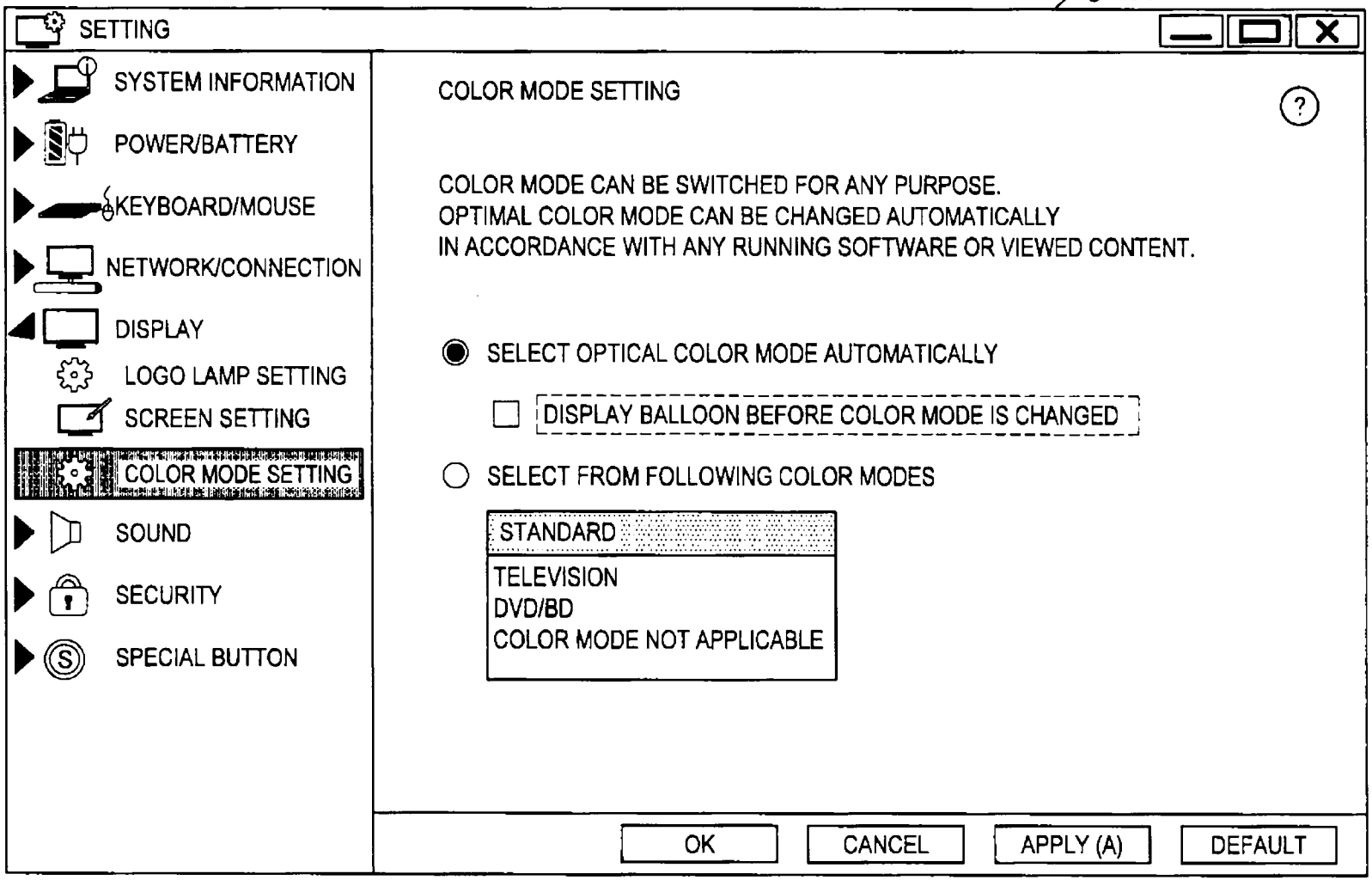
FIG. 6 is a view for explaining user's selecting an image quality mode according to the embodiment.

Next description is made, with reference to FIG. 6, about selection of the image quality mode by the user. FIG. 6 is an explanatory view for explaining an example of the image quality mode selecting screen. As shown in FIG. 6, the user selects "display" on the setting screen in the window and then "color mode setting". After this selection, the color mode setting screen 400 is displayed in the window.

The user selects either of "Select optical color mode automatically" or "Select from the following color modes" in the color mode setting screen 400. When the "Select optical color mode automatically" in the color mode setting screen 400 is selected, the image quality correction utility 10 select the image quality mode in accordance with the running application.

On the other hand, when the "Select from the following color modes" in the color mode setting screen 400 is selected, the image quality correction utility 10 selects the image quality mode selected by the user. The image quality modes selected by the user may include, for example, standard mode, television mode, DVD/BD mode and print mode.

Next, with reference to FIG. 7, the image quality modes and the image quality parameters 450 set for the respective image quality modes are described by way of example. FIG. 7 is an explanatory view showing the image quality mode setting list 500. As shown in FIG. 7, the image quality modes include, for example, standard mode, DVD/BD mode, TV mode, x. v. color mode, print mode and external output mode.

As shown in FIG. 7, the plurality of image quality parameters are associated with the respective image quality modes and stored in the storing unit 160. Further, the application programs and the image quality modes are associated with each other and stored in the storing unit 160. Therefore, if the image quality correction utility 10 determines the running application program, the corresponding image quality mode is selected. Further, the image quality parameters are changed to image quality parameters associated with the selected image quality mode. Characteristics of respective modes are described below.

The standard mode is a standard setting suitable for general use. In the standard mode, the panel color temperature is set to D65 (about 6,500 K) and ICC monitor profile of the display is set. More specifically, the panel color temperature is set to D65, and this setting is used as a basis to perform gamma correction, which is then used as a basis to create and set the monitor profile.

In addition, when pictures or the like are edited or reproduced by an application for ICC monitor profile, the monitor is capable of as displays of precise colors as possible. For moving images, the monitor is capable of display with natural colors or hue suitable for general use. This setting is suitable for general purpose and does not break any contents.

The DVD/BD mode is a setting suitable for watching movie films by the DVD or BD. Image quality correction is performed in such a manner that the video reproduced by the DVD or BD is displayed with natural and rich colors or hue. More specifically, the moving image color correction values are optimized to display the images with clear colors. Then, the gamma correction of the display is optimized as necessary.

The TV (television) mode is a setting suitable for watching TV programs or the like. Image quality correction is performed in such a manner that the video reproduced by TV application is displayed bright and vivid colors. More specifically, the moving image color correction values are optimized to display the images with clear colors. Then, the gamma correction of the display is optimized as necessary.

The x. v. color mode is a setting suitable for display of the contents ready for x. v. colors so that vivid flower colors and beautiful blue and green of tropical islands, which were difficult to reproduce, can be reproduced more closely. As specific setting values, color conversion coefficients created based on the color area information of the LCD panel are set, and color space conversion is validated for moving images. At the same time, image creation is returned to the original, and color reproduction is performed with as close colors as possible.

The print mode is a mode appropriate for editing printing pictures. Particularly, it is suitable for display by an application for ICC monitor profile. More specifically, the panel color temperature is set to D50 (about 5,000 K) and gamma correction is performed based on this setting. Further, the setting of the gamma correction is used as a basis to create and set the monitor profile. Optimization is not performed for moving images.

The external output mode is a setting suitable for displaying on an external display. The gamma correction, moving color correction and the like may be set to the default and the panel color temperature, the ICC monitor profile and the like may be set in accordance with the selected mode. Up to this point, the image quality modes have been described.

Next description is made about the details of the typical image quality parameters. The display gamma correction is a parameter for correcting of RGN channels of the LCD panel to be displayed with smooth gradients. A gamma correction table is set using the API of the OS. The moving image color correction is a parameter for correcting the brightness contrast, tint, color saturation and the like in such a manner that contents can be displayed optimally on the TV, BD/DVD. The moving image color correction is set using the API of the graphics device driver.

The ICC monitor profile (static image color space conversion parameter) is a parameter for displaying the picture opened with use of image editing application software as closely to the actual colors as possible. The ICC monitor profile parameter is set in the OS with the property of the LCD panel as ICC profile.

The color conversion Matrix (moving color space conversion parameter) is a parameter for displaying the contents having xvYcc color space on the monitor as close to the actual colors as possible. The LCD panel property information is set in the driver as Color Conversion Matrix.

The panel color temperature is a parameter for making the color temperature selectable depending on the purpose. It is set with the use of a function specific to the LCD panel. Up to this point, the details of the image quality parameters have been described.

Figure 8:
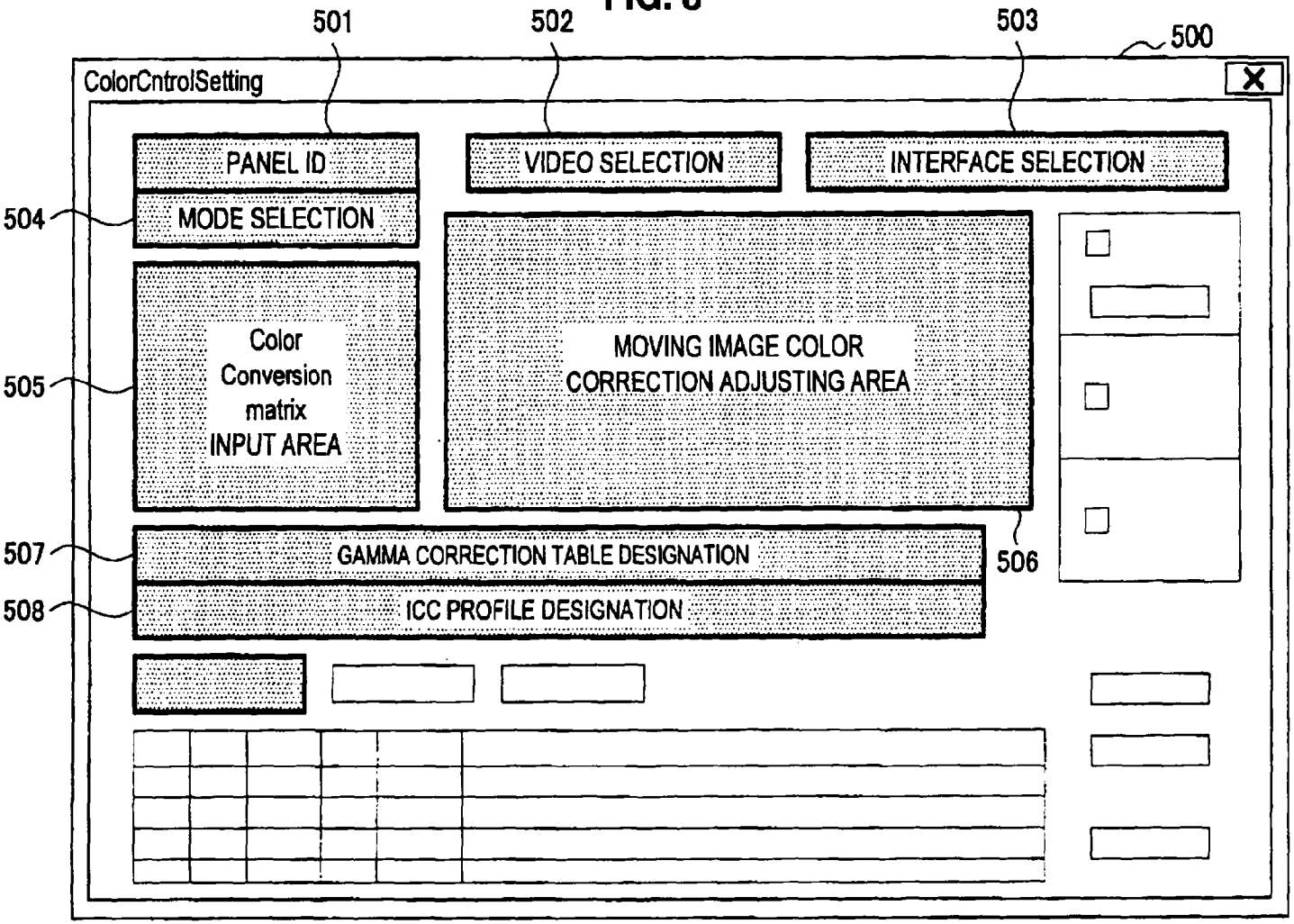
FIG. 8 is an explanatory view for explaining the setting value creating tool for setting image parameters according to the embodiment.

Next description is made, with reference to FIG. 8, about the setting value creating tool for setting the image quality parameters in association with the image quality modes shown in FIG. 7. With use of this setting value creating tool, the image quality mode and the image quality mode parameters can be set by simple operation.

In the setting value creating tool, each item is input by the user using the setting value creating screen. FIG. 8 is an explanatory view for explaining a display example of the setting value creating screen 500. As shown in FIG. 8, the setting value creating screen 500 includes a panel ID input area 501 for inputting a panel ID, a video ID selection area 502 for selecting a video ID, an interface selection area 503 for selecting an interface, a mode selection area 504, a color conversion matrix input area 505, a static image color correction/moving image color correction adjusting area 506, a static image color correction table designation area 507 and an ICC profile designation area 508.

Parameters are input to respective areas by user's operation. In the panel ID input area 501, parameters may be input in advance with the use of results determined by the determining unit 152. In addition, in the video ID selection area 502, the interface selection area 503 and the mode selection area 504, a predetermined number of selection items may be prepared in advance so that a desired item can be selected from the selection items.

For the setting values of each input area, the image quality mode is associated with the plurality of image quality parameters by inputting and selecting of the user. Each image quality mode set in the setting value creating screen 500 is associated with the plurality of image quality parameters and stored in the storing unit 160. Description made up to this point is all about the setting value creating tool.

[4] Operation of Information Processing Apparatus

Figure 9:
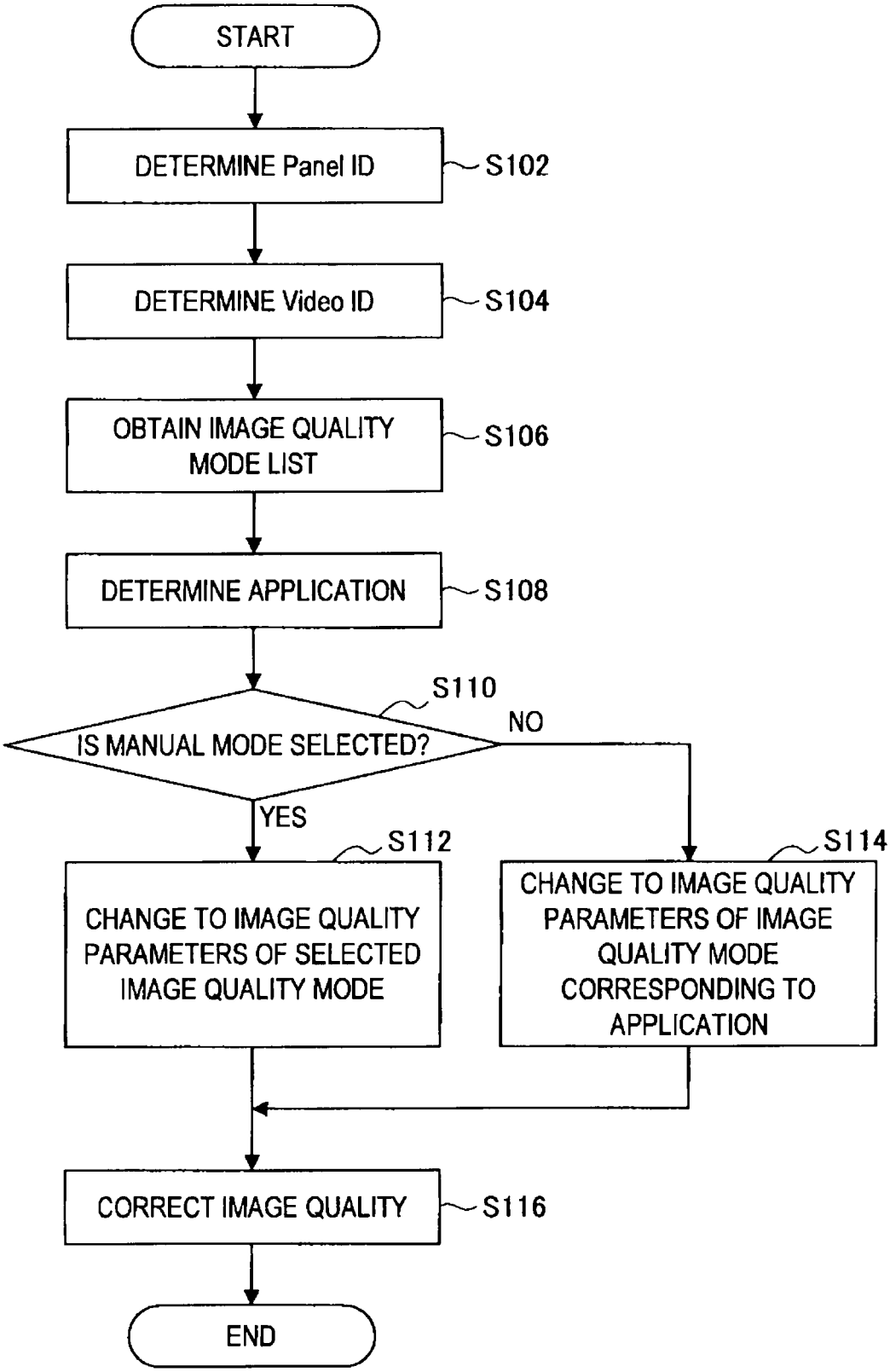
FIG. 9 is a flowchart for showing an information processing method of the information processing apparatus according to the embodiment.

Up to this point, the functional structure of the information processing apparatus 100 has been described. Next description is made about, with reference to FIG. 9, the information processing method of the information processing apparatus 100. FIG. 9 is a flowchart for explaining the information processing method of the information processing apparatus 100.

As shown in FIG. 9, first, the determining unit 152 of the information processing apparatus 100 determines the "Panel ID" of the LCD panel (S102). Next, the determining unit 152 determines the "Video ID" of the graphics model (S104). Then, a list of the image quality modes determined by the "Panel ID" and the "Video ID" is obtained (S106).

Next, the determining unit 152 determines the running application (S108). Further, it is determined whether the manual mode is selected or not, that is, whether the image quality mode is selected by the user or not (S110).

In the step S110, if it is determined that the manual mode is selected, the changing unit 156 changes the preset image parameters to image quality parameters associated with the image quality mode selected by the user (S112).

In the step S110, if it is determined that the manual mode is not selected, the selecting unit 154 selects the image quality mode associated with the application program determined in the step S108. Then, the changing unit 156 changes the preset image quality parameters to the image quality parameters associated with the selected image quality mode (S114).

Then, the image quality parameters changed in the step 112 or 114 are used to correct the image quality of the display (S116). The description made up to this point is all about the information processing method of the information processing apparatus 100.

According to the information processing apparatus 100 of this embodiment, the running application program is determined, which is used as a basis to change the plurality of image quality parameters for setting the image quality of the display screen 109. With this structure, the image quality parameters can be set optimally in accordance with the running application program.

In addition, as the application program is stored in association with the plurality of image quality parameters, the image quality parameters can be set appropriately by changing the plurality of image quality parameters to those associated with the determined application program.

Further, the used LCD panel and/or graphics model can be used to change the plurality of image quality parameters. With this structure, the plurality of image quality parameters can be set collectively in consideration of the LCD panel, the running application and the like.

Furthermore, the plurality of image quality parameters include parameters for correcting image quality of static image contents or moving image contents and parameters for correcting the color temperature of the panel. With this structure, the various image quality parameters depending on each other can be set collectively in consideration of the LCD panel, the running application and the like.

Furthermore, the plurality of image quality parameters are associated with a plurality of image quality modes set for respective display purposes and stored, then the image quality mode is selected in accordance with the running application program. The plurality of image quality parameters may be set to a plurality of image quality parameter associated with the selected image quality mode. With this structure, the various image quality parameters depending on each other can be set only by selecting the image quality mode.

Furthermore, a predetermined number of image quality modes may be prepared so that the user can select a desired image quality mode from the predetermined number of image quality modes. With this structure, the user can optimize the image quality setting easily without regarding to the existence of each image quality parameters.

The present application contains subject matter related to that disclosed in Japanese Priority Patent Application JP 2008-221855 filed in the Japan Patent Office on JP Aug. 29, 2008, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

For example, in the embodiment, it is determined what the running application program is. However, the present invention is not limited to this example. For example, the API of the application program may be used to determine what mode the running application program is. For example, one application program may have a plurality of modes for playing a plurality of media like DVD and TV programs. In such a case, it may be determined of which mode the application program is, which determined mode may be used as a basis to set the image quality parameters.

Further, the application program or video driver API may be used to determine the format of content data. For example, it is determined whether the content data is HD or SD, or whether the color area of the content data is ITU-R BT. 709 or ITU-R BT. 601, or whether it is of xvYcc or not. Then, the image quality parameters may be set in accordance with the format of the determined content data.

What is claimed is:

1. An information processing apparatus comprising:

circuitry configured to:

start any one of a plurality of application programs and displaying contents on a display screen;

determine at least one of identification information of a type of the display screen and identification information of a type of graphics model used with the display screen;

obtain a plurality of image quality modes set for respective display purposes based upon the at least one of the identification information of the type of the display screen and the identification information of the type of graphics model, each of the image quality modes prescribing a plurality of image quality parameters for setting image quality of the display screen;

determine the application program started;

determine whether a user has manually selected one of the image quality modes;

change the plurality of image quality parameters in accordance with the determined application program when the user has not manually selected one of the image quality modes; and change the plurality of image quality parameters in accordance with the one of the image quality modes manually selected by the user when the user has manually selected one of the image quality modes.

2. The information processing apparatus according to claim 1, wherein the circuitry is further configured to store identification information of the application program as associated with the image quality parameters, determine the identification information of the application program started, and change the image quality parameters for setting the image quality of the display screen to the image quality parameters associated with the determined identification information of the application program.

3. The information processing apparatus according to claim 2, wherein the circuitry is configured to:

select any of the image quality modes in accordance with the determined application program, and change the image quality parameters for setting the image quality of the display screen to the image quality parameters associated with the selected image quality mode.

4. The information processing apparatus according to claim 3, wherein the circuitry is configured to store a predetermined number of the image quality modes as associated with identification information of the application programs.

5. The information processing apparatus according to claim 1, wherein the application programs are programs for displaying static image contents or moving image contents on the display screen.

6. The information processing apparatus according to claim 1, wherein the image quality parameters include parameters for correcting image quality of static image contents or moving image contents.

7. The information processing apparatus according to claim 1, wherein the image quality parameters include parameters for correcting panel color temperature.

8. The information processing apparatus according to claim 1, wherein in a case that a plurality of the plurality of application programs run simultaneously, the circuitry is configured to determine the application program started as the application program that is in a foreground of the display screen.

9. The information processing apparatus according to claim 1, wherein the circuitry is configured to invalidate change of the image quality parameters when the display screen is mounted on a display device external to the information processing apparatus.

10. The information processing apparatus according to claim 9, wherein to invalidate change of the image quality parameters, the circuitry is configured to set the image quality parameters to default values.

11. The information processing apparatus according to claim 9, wherein to invalidate change of the image quantity parameters, the circuitry is configured to set at least one of the image quality parameters to a default value.

12. The information processing apparatus according to claim 1, wherein the plurality of image quality modes includes at least:

a standard mode,
a DVD/BD mode,
a television mode,
an x. v. Color mode,
a print mode, and
an external output mode.

13. The information processing apparatus according to claim 12, wherein each of the plurality of image quality modes prescribes settings for at least:

display gamma correction,
moving image color correction,
static image color space conversion,
moving color space conversion, and
panel color temperature.

14. The information processing apparatus according to claim 12, wherein each of the plurality of image quality modes prescribes settings for at least one of:

display gamma correction,
moving image color correction,
static image color space conversion,
moving color space conversion, and
panel color temperature.

15. The information processing apparatus according to claim 1, wherein the plurality of image quality modes includes at least one of:

a standard mode,
a DVD/BD mode,
a television mode,
an x. v. Color mode,
a print mode, and
an external output mode.

16. The information processing apparatus according to claim 15, wherein each of the plurality of image quality modes prescribes settings for at least:

display gamma correction,
moving image color correction,
static image color space conversion,
moving color space conversion, and
panel color temperature.

17. The information processing apparatus according to claim 1, wherein each of the plurality of image quality modes prescribes settings for at least:

display gamma correction,
moving image color correction,
static image color space conversion,
moving color space conversion, and
panel color temperature.

18. The information processing apparatus according to claim 1, wherein each of the plurality of image quality modes prescribes settings for at least one of:

display gamma correction,
moving image color correction,
static image color space conversion,
moving color space conversion, and
panel color temperature.

19. An information processing method comprising the steps of:

starting, via circuitry of an information processing apparatus, any one of a plurality of application programs and displaying contents on a display screen;

determining, via the circuitry, at least one of identification information of a type of the display screen and identification information of a type of graphics model used with the display screen;

obtaining, via the circuitry, a plurality of image quality modes set for respective display purposes based upon the at least one of the identification information of the type of the display screen and the identification information of the type of graphics model, each of the image quality modes prescribing a plurality of image quality parameters for setting image quality of the display screen;

determining, via the circuitry, the application program started;

determining, via the circuitry, whether a user has manually selected one of the image quality modes;

changing, via the circuitry, the plurality of image quality parameters for in accordance with the application program determined when the user has not manually selected one of the image quality modes; and;

changing, via the circuitry, the plurality of image quality parameters in accordance with the one of the image quality modes manually selected by the user when the user has manually selected one of the image quality modes.

20. A non-transitory medium storing a program for making circuitry of an information processing apparatus function as:

a display controlling unit for starting any one of a plurality of application programs and displaying contents on a display screen;

a determining unit for determining at least one of identification information of a type of the display screen and identification information of a type of graphics model used with the display screen, obtaining a plurality of image quality modes set for respective display purposes based upon the at least one of the identification information of the type of the display screen and the identification information of the type of graphics model, each of the image quality modes prescribing a plurality of image quality parameters for setting image quality of the display screen, determining the application program started by the display controlling unit, and;

determining whether a user has manually selected one of the image quality modes; and a changing unit for changing the plurality of image quality parameters in accordance with the application program determined by the determining unit when the user has not manually selected one of the image quality mode, and changing the plurality of image quality parameters in accordance with the one of the image quality modes manually selected by the user when the user has manually selected one of the image quality modes.

* * * * *